United States Patent [19]

Packer

[11] 4,098,082

[45] Jul. 4, 1978

[54] WAVE-MOTION COMPENSATING APPARATUS FOR USE IN CONJUNCTION WITH AN OFF-SHORE CRANE, OR THE LIKE

[76] Inventor: Martin R. Packer, 3 Cherington Close, Handforth, Cheshire, SK93AS, England

[21] Appl. No.: 779,065

[22] Filed: Mar. 18, 1977

[51] Int. Cl.[2] ..... F15B 1/02

[52] U.S. Cl. ..... 60/413; 254/172

[58] Field of Search ..... 60/369, 371, 372, 398, 60/413, 403, 406, 415, 418; 91/4, 390; 254/172

[56] References Cited

U.S. PATENT DOCUMENTS

| | | | |
|---|---|---|---|
| 2,554,381 | 5/1951 | Patterson | 60/398 X |
| 2,641,106 | 6/1953 | Jelinek | 60/403 X |
| 2,645,899 | 7/1953 | Aller et al. | 60/372 |
| 3,842,603 | 10/1974 | Ditzen | 91/390 X |
| 3,902,319 | 9/1975 | Olmsted | 60/413 |
| 4,046,270 | 9/1977 | Baron et al. | 60/413 X |

*Primary Examiner*—Edgar W. Geoghegan
*Attorney, Agent, or Firm*—Keith D. Beecher

[57] ABSTRACT

Wave-motion compensating apparatus for a crane is provided, which includes a hydro-pneumatic accumulator and an hydraulic ram, and additional components for controlling the fluid connection between the accumulator and the ram. The apparatus is intended to be coupled to a crane on an off-shore oil drilling rig, or the like, and it serves to compensate for the rising and falling wave motion between a vessel being unloaded and the crane. The compensating apparatus initially causes the load carrying cable of the crane to be maintained at a slight substantially constant tension permitting the load to rise and fall with the motion of the vessel. The apparatus at this time extracts and stores energy from the up and down motion of the load; then, after a few up and down cycles, the apparatus exerts a lifting force on the cable to lift the load clear of the crest of the next wave. The foregoing is achieved without the need for any external energy source apart from the wave motion itself. The crane then takes over and the energy stored in the compensating apparatus slowly bleeds away, and the apparatus is returned to a reset condition for the next load.

7 Claims, 2 Drawing Figures

WAVE-MOTION COMPENSATING APPARATUS FOR USE IN CONJUNCTION WITH AN OFF-SHORE CRANE, OR THE LIKE

BACKGROUND OF THE INVENTION

Hydro-pneumatic mechanisms are known in which the fluid side of a hydro-pneumatic accumulator is connected to the cylinder of an hydraulic ram to impose a restraint on the movement of the piston of the ram when the piston is subjected to external influences. Such prior art assemblies have been used, for example, in the suspensions of motor vehicles as shock absorbers, and have been used for similar purposes in other apparatus and equipment.

In such prior art hydro-pneumatic mechanisms, the fluid connection between the accumulator and the ram is permanently open, so that the ram is at all times subjected to the influence of the accumulator. The compensating apparatus of the present invention, however, is predicated upon modifying the operation of the ram by controlling the fluid connection between the accumulator and the ram. With such a control, compensating apparatus can be provided which is of particular utility in certain environments, and which can, if so desired, be constructed to derive energy from the environment itself to perform certain operations.

For example, apparatus constructed in accordance with the concepts of the present invention, may be used as a wave-motion compensator in conjunction, for example, with a crane on an offshore oil drilling rig for loading or unloading a vessel which is rising and falling with respect to the rig assembly. More specifically, the apparatus of the present invention in the embodiment to be described, may be coupled to the load-carrying cable of the crane in such a manner that the crane cable is initially maintained at a substantially constant slight tension as the load is rising and falling relative to the crane, and then serves to pick the load off the crest of a wave to permit it to be hoisted onto the rig.

In the embodiment of the wave-motion compensating apparatus to be described, the fluid coupling between the accumulator and the ram is maintained open for a particular interval to permit the load to rise and fall relative to the crane, and the coupling is then closed so that the load is no longer able to fall with the wave motion, but is taken up and supported by the crane. The combination of the invention, as will be described, is also capable of then introducing energy into the ram, so as to enable the compensating apparatus to continue to move the load upwardly from the crest of the wave. Energy derived from the wave motion itself is used to charge the separate source in the embodiment to be described, so that the apparatus may be self-contained and require no additional external energy source.

DETAILED DESCRIPTION OF THE ILLUSTRATED EMBODIMENT

Figure 1:
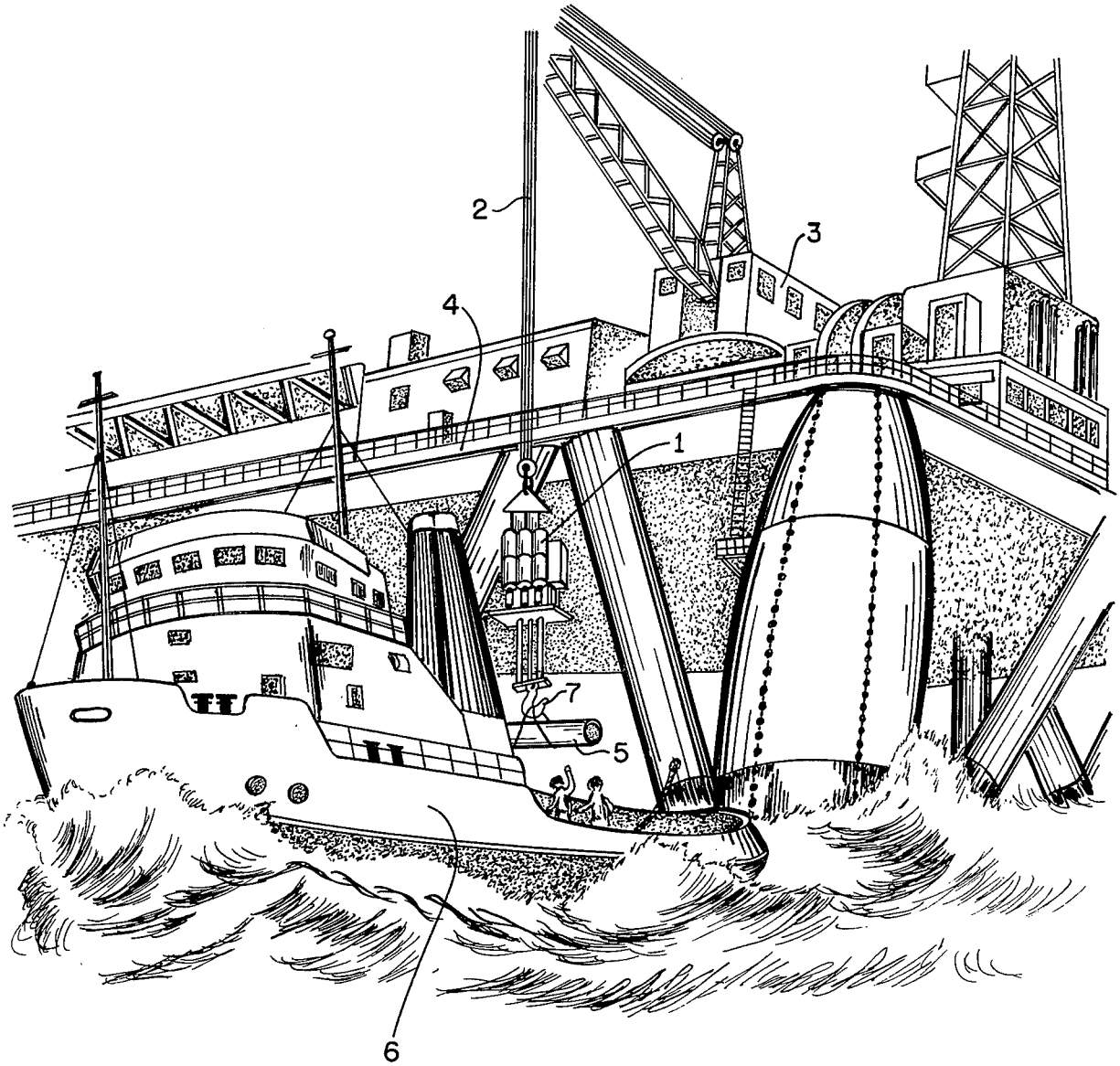
FIG. 1 is a representation of the compensating apparatus of the invention mounted on the cable of a crane on an offshore oil drilling rig.

FIG. 1 shows wave-motion compensating apparatus 1, constructed in accordance with the invention, mounted on the load carrying cable 2, of a crane 3; the crane being mounted on an offshore oil drilling rig 4. The crane is in the process of unloading a load 5 from a vessel 6, the load being coupled to the apparatus by a hook 7.

The wave-compensating apparatus serves initially to permit the load 5 to move up and down with the vessel 6 when it is attached to the crane cable 2. However, after a number of such up and down movements, the compensating apparatus acts to pick the load up at the crest of a wave and continues its upward motion, so as to lift the load clear of the vessel. The crane itself then takes over and hoists the load up onto the rig.

Figure 2:
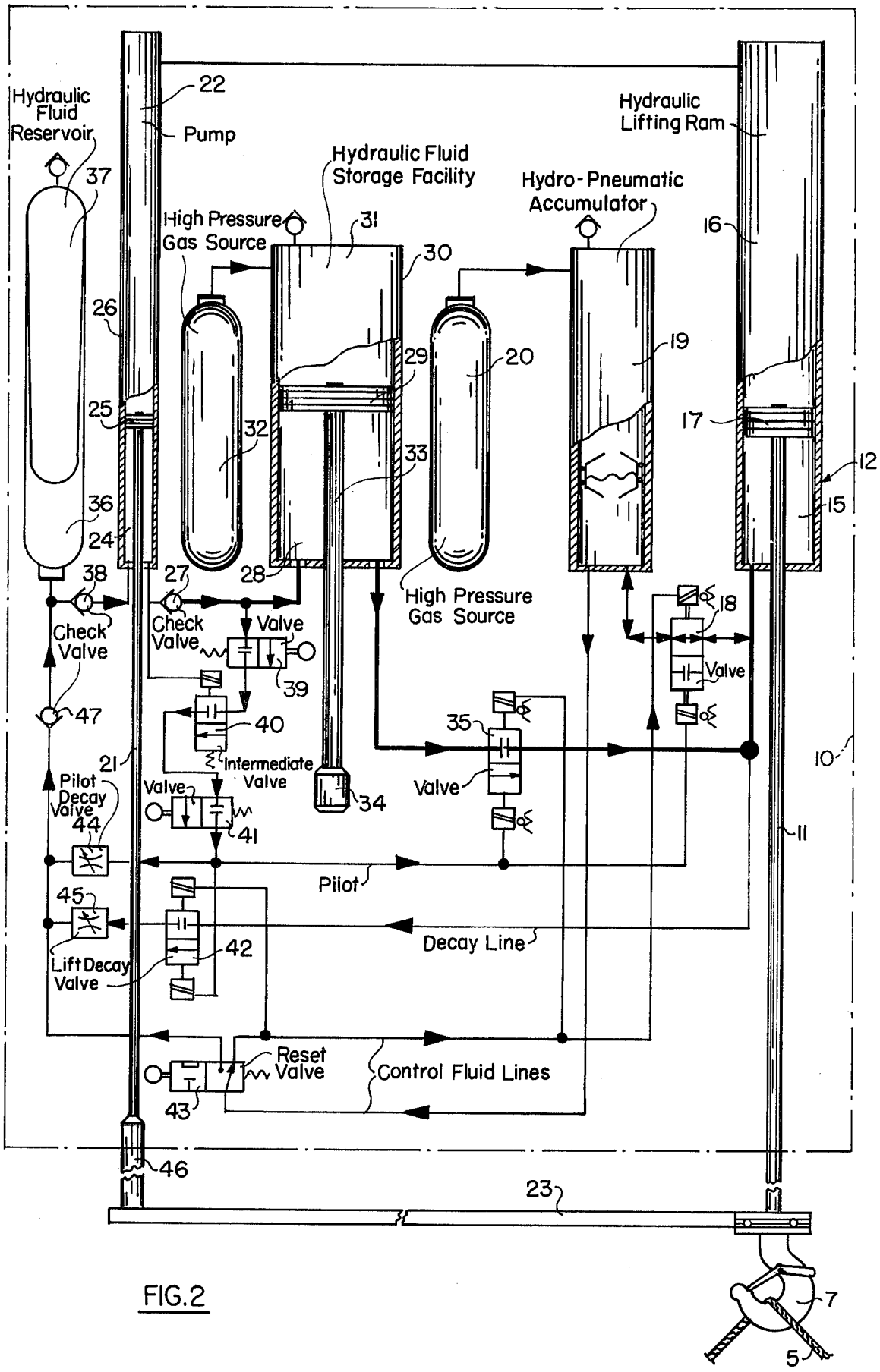
FIG. 2 is a schematic representation of one embodiment of the apparatus of the invention.

As shown in FIG. 2, the wave-motion compensating apparatus 1 may be enclosed in a sealed housing indicated generally as 10, and from which a ram piston rod 11 of an hydraulic lifting ram 12 projects vertically downwardly, the rod 11 having hook 7 mounted on its lower end for carrying loads, indicated schematically in FIG. 2. Space 15 in the cylinder 16 of ram 12, below the ram piston 17, is connected by way of a pilot-operated compensating valve 18 to the liquid side of a hydro-pneumatic accumulator 19, the gas side of which is connected to a high pressure gas source, such as nitrogen-containing tank 20.

It will readily be understood that, with the accumulator 19 having an appropriate volumetric capacity, and with the housing 10 suspended from cable 2 of crane 3 (FIG. 1), mounted on a relatively stationary base, such as off-shore oil rig 4; and with the rising and falling load 5 (such as an item of cargo on vessel 6) alongside the rig 4 and connected to the hook 7, the accumulator 19 operates to insure that the piston 17 and hook 7 are caused to rise and fall in synchronism with the rise and fall of the load 5, maintaining a substantially tension on the crane cable 2 from which the compensating apparatus 1 is suspended.

The compensating apparatus of the invention, in the illustrated embodiment, initially derives energy from the rising an falling motion of load 5. For this purpose, the ram piston rod 11 is mechanically connected to the piston rod 21 of a reciprocating pump indicated generally by the number 22. This mechanical connection is illustrated as being by way of an extended cross-bar 23 in FIG. 2, but it has been so illustrated simply for ease of understanding the operation of the combination. In practice, the pump 22 is positioned closely adjacent to the hyraulic lifting ram 12, and there is only a short mechanical connection therebetween.

The space 24 below the piston 25 in cylinder 26 of the pump 22 is connected through a check valve 27 to the space 28 beneath the piston 29 in the cylinder of an hydraulic fluid storage facility 30. In turn, the space 31 in the storage facility above piston 29 is connected to a source of pressurized gas 32, such as a nitrogen tank, so that piston 29 may be loaded by nitrogen gas at very high pressure. The piston rod 33 of the storage facility 30 extends downwardly out of the cylinder. An actuator cam or lobe 34 is mounted on the lower end of the piston rod 33. The space 28 below the piston 29 is connected by way of a pilot operated valve 35 to the space 15 in the cylinder 16 of ram 12 below the ram piston 17.

A sealed hydraulic fluid reservoir 36 is connected to the space 24 below the pump piston 25 by way of a check valve 38. A pressurized bladder 37 is enclosed within the fluid reservoir, the bladder being filled with nitrogen, or other pressurized gas, at a relatively low pressure, thereby to impose a correspondingly low pressure on the hydraulic fluid contained in the reservoir.

As will be described, upon operation of the apparatus, pump 22 pumps hydraulic fluid from reservoir 37 into the space 28 of the hydraulic fluid storage facility below piston 29. The pump also pumps pilot control fluid to an intermediate pilot operated valve 40. A valve 39 also receives fluid from pump 22, and, when open, passes the fluid through valve 40 and through a valve 41 to the pilot control of valve 18, and to the pilot control of a further valve 35. The foregoing action serves to open valve 35 and to close valve 18, when valves 39, 40 and 41 are open. Valve 40 assures that pilot control fluid will flow from valve 39 to valve 41 only when piston 25 in pump 22 is moving upwardly. Valve 39 is operated by cam 34 on piston rod 33 to be opened only when the storage facility 30 is full. Valve 41 is operated by a cam 46 on piston rod 21 to be operated and open only when the piston 25 in pump 22 is at the upper extremity of its stroke. Valve 41 or cam 46 may be linearly adjustable relative to one another by a slide and ratchet, or similar mechanism.

Valve 35 is positioned in a conduit between the storage facility 30 and the space 15 or ram 12, so that the hydraulic fluid from the storage facility will be forced into the space 15 of ram 12 when valve 35 is open. When valve 35 is closed, and valve 18 is open, piston 17 in ram 12 will move upwardly and downwardly with the load, forcing the hydraulic fluid back into the accumulator 19 during its down stroke, and drawing the hydraulic fluid from the accumulator 19 during its up stroke.

The apparatus also includes a valve 42 positioned in a bleed line from the space 15 of ram 12 which, when open, causes the hydraulic fluid in the space 15 to bleed back to the reservoir 36, the rate of flow of the fluid may be controlled by a manually operated valve 45. Also, the pilot fluid controlling valves 42, 35 and 18 is also bled back to reservoir 36 through a manually controlled valve 44. A reset valve 43 is provided which is operated by an appropriate spring when disengaged from the cam 46 when the piston 25 is at its down position, to reset the system, as will be described.

Assuming the housing 10 of the wave compensating apparatus 1 to be substantially stationary, and the load 5 to be rising and falling, pump 22 will draw low pressure hydraulic fluid from the reservoir 36, and it will pump the fluid into the storage facility 30, thereby causing piston 29 and piston rod 33 gradually to rise. When the storage facility 30 becomes full, cam 34 on the end of piston rod 33 actuates valve 39 thereby causing hydraulic fluid to flow through valve 40 to valve 41. Valve 40 is open at this time when piston 25 is rising in the pump 26 and, hence, there is a substantially low pressure in the pilot side of valve 40, and therefore the spring on the other side of valve 40 opens valve 40.

Now, when the load and pump rod 21 rises, then at the top of the rising movement, cam 46 on the end of the pump rod actuates the valve 41, thereby causing valve 41 to pass pilot control fluid to valves 35 and 18, causing valve 18 to close and valve 35 to open within a few milliseconds thereafter. The closure of valve 18 closes the path between the ram 16 and accumulator 19, and the opening of valve 35 forces the hydraulic fluid in space 28 of storage facility 30 into space 15 of ram 12, causing the rod 11 to continue its upward movement, drawing with it hook 7 and load 5.

The inertia of the load is overcome by the movement of the sea, and the discharge of the hydraulic fluid from the storage facility 30 merely serves to continue the upward movement of the load without any tendency to shock load the crane. Since the storage facility 30 is connected to a relatively small gas source 32, the additional force applied to piston 17 when valve 35 is opened decreases during the retraction of rod 11, as the hydraulic fluid is discharged from the facility and the gas introduced to the facility expands. The rate of retraction of rod 11 decreases from the rate of wave rise motion and, as it does, the load is progressively taken by the crane 3 (FIG. 1) on which the assembly is hung.

Therefore, it will be understood that then the storage facility 30 is filled with hydraulic fluid under pressure by the pumping action of pump 22, valve 39 is actuated by cam 34 to make the compensating apparatus of the invention ready for lifting the load 5. Then, when load 5 next rises to the apex of its wave motion, valve 41 operates to interrupt the connection between accumulator 19 and ram 12, so that the action of ram 12 is modified to prevent the load from falling again concomitant with the falling portion of the wave motion, and simultaneously to release pressurized hydraulic fluid into the space 15 in ram cylinder 16 to raise the hook 7 and load 5 relative to the wave motion.

Accordingly, the illustrated apparatus operates automatically first to enable the load 5 to follow the wave motion on which it is supported; and, simultaneously to supply energy to the energy storage facility 30, which energy is derived from the wave motion. Then, upon the energy storage facility becoming adequately charged, the apparatus serves to arrest the reciprocation of piston 17 of ram 12 at a wave crest, and it also serves to supply energy to the ram 12, thereby to insure that the load is lifted up from its wave top position.

After the load has been effectively automatically lifted at the crest of a wave, it can then be appropriately maneuvered in the usual way by crane 3 of FIG. 1, and can be deposited where required on rig 4. The actuation of valve 41 by cam 46, when the apparatus is arrested at the crest of the wave, also causes valve 41 to supply pilot control fluid to an operating means for valve 42, to open a bleed line and bleed the fluid from space 15 in ram cylinder 16 back to the hydraulic fluid reservoir 36. This action permits a slow decay of pressure from space 15, so that upon the load having been raised off the crest of a wave by the force derived from the energy storage facility 30, and while the load is being maneuvered by conventional operation of the crane 3, piston 17 of ram 12 will fall back slowly to its lowermost position at a speed controlled by the setting of valve 45.

It will be understood that when the piston 17 and load 5 are raised by energy derived from the storage facility 30, reset valve 43 will be closed by reason of its being engaged by cam 46. However, upon the piston 17 falling back to its lowermost position, as discussed above, the pump rod 21 is correspondingly lowered, and the reset valve 43 is subsequently disengaged from cam 46 and open, which causes pilot control fluid from the accumulator 19 to be introduced to operating means for valves 42, 35 and 18, to close valves 42 and 35, and to open valve 18, thereby accomplishing a reset condition in the apparatus. Piston 17 is again free to move up and down with the wave motion, and to draw hydraulic fluid from accumulator 19 through valve 18, and to force hydraulic fluid back into accumulator 19 through valve 18, as described above.

It is to be understood that although the apparatus of the present invention has been described herein as wave-motion compensating apparatus used in conjunction with an off-shore crane, the apparatus has a wider application. In its broadest aspect, the apparatus of the invention comprises a hydro-pneumatic spring assembly which includes means enabling the liquid connection between the accumulator and the ram of the assembly to be closed off, thereby to modify the operation or actuation of the ram. The hydro-pneumatic spring assembly of the invention may form part of a wave-motion compensator, such as described above, in which the assembly is used in an environment in which the motion of waves influences working operations, for example, the loading or unloading of a supply ship, or barge, or the like, at a stationary or near stationary semi-submersible off-shore structure.

In such a practical use, the wave-motion compensator is attached to the cable of a crane, such as illustrated in FIG. 1, in such a manner that the hydro-pneumatic spring assembly of the invention operates to insure the load-carrying cable of the crane is maintained under a near constant slight tension even though the load is rising and falling relative to the crane.

In the apparatus described above, a signal is generated at a particular time to close the valve controlling the liquid connection between the accumulator and the ram when the load has been raised to a maximum height by a wave, so that the load is no longer able to fall again with the wave motion, but continues up and becomes supported by the crane. The assembly is such that the signal also serves to enable energy from a separate source to be supplied to the ram, thereby to raise the load by the crane at the wave top position. In the embodiment described, the wave motion itself is used to charge the separate source, so that the entire wave-motion compensator may be a self-contained unit requiring no additional external energy supply.

It will be appreciated that while a particular embodiment of the invention has been shown and described, modifications may be made. It is intended in the claims to cover all the embodiments which come within the true spirit and scope of the invention.

What is claimed is:

1. In combination: a hydro-pneumatic accumulator having a gas side and an hydraulic fluid side and constituting a first source of hydraulic fluid; means for introducing a pressurized gas to the gas side of the accumulator; an hydraulic ram; first conduit means coupling the hydraulic fluid side of the accumulator to the ram to introduce hydraulic fluid from the accumulator into the ram; valve means in said first conduit means; control means coupled to said valve means and responsive to a control effect for causing the valve means to close and terminate the introduction of hydraulic fluid from the accumulator into the ram; a second source of hydraulic fluid comprising a storage means, an hydraulic fluid reservoir, and a pump comprising a cylinder and a piston reciprocally movable in said cylinder for introducing hydraulic fluid from said hydraulic fluid reservoir into said storage means; and second conduit means coupled to said second source for introducing hydraulic fluid from said source into said ram.

2. The combination defined in claim 1, and which includes valve means in said second conduit means, and control means coupled to said storage means and to said piston of said pump means for causing said valve means in said first conduit means to close and for causing said valve means in said second conduit means to open when a predetermined amount of hydraulic fluid has been pumped into said storage means by said pump, and for a first predetermined position of said piston of said pump.

3. The combination defined in claim 2, in which said storage means includes a cylinder and a piston reciprocally movable in said cylinder, and in which said control means comprises a first control valve operated by said piston of said storage means and a second control valve operated by said piston of said pump for introducing pilot control fluid from said pump to operating means for said valve means in said first conduit means and to operating means for said valve means in said second conduit means.

4. The combination defined in claim 2, and which includes third conduit means coupling said ram to said hydraulic fluid reservoir, and valve means in said conduit means and operated by said control means to open and cause hydraulic fluid and said ram to bleed back to said hydraulic fluid reservoir.

5. The combination defined in claim 4, in which said control means comprises a first control valve operated by the piston of said storage means and a second control valve operated by the piston of said pump for introducing a pilot control fluid from said pump to operating means for said valve means in said third conduit means.

6. The combination defined in claim 4, and which includes reset valve means actuated by the piston of said pump for causing said valve means in said first conduit means to open, and said valve means in said conduit means to close, an said valve means in said third conduit means to close, when the piston of said pump assumes a second predetermined position.

7. In combination: a hydro-pneumatic accumulator; an hydraulic ram including a cylinder and an internal piston; first conduit means coupling the ram to the hydraulic accumulator; valve means in said first conduit means which when open permits the ram piston to move reciprocally up and down in said cylinder forcing hydraulic fluid into the accumulator during its upward stroke and drawing hydraulic fluid from the accumulator during its downward stroke; control means coupled to said valve means and responsive to a control effect for causing the valve means to close and terminate any further downward movement of the piston in said cylinder; a source of hydraulic fluid; second conduit means coupling said source of hydraulic fluid to the cylinder of said hydraulic ram; second valve means in said second conduit means; and second control means coupled to said second valve means and responsive to said control effect for causing said second valve means to open in response to said control effect to introduce hydraulic fluid from said source into said ram cylinder and thereby to produce upward movement of said ram piston.

* * * * *